United States Patent [19]

Buschle

[11] Patent Number: 4,598,478

[45] Date of Patent: Jul. 8, 1986

[54] SHARPENER PRESS-BUTTON

[76] Inventor: Richard D. Buschle, Rod.Presidente Dutra Km 181, Nova Iguacû, Rio de Janeiro, Brazil

[21] Appl. No.: 749,364

[22] Filed: Jun. 27, 1985

[30] Foreign Application Priority Data

Jul. 11, 1984 [BR] Brazil ..... 8403454

[51] Int. Cl.[4] ..... B26B 23/00

[52] U.S. Cl. ..... 30/457; 30/459; 7/160

[58] Field of Search ..... 145/3.5, 3.6, 3.61; 30/457, 458, 459; 7/160

[56] References Cited

U.S. PATENT DOCUMENTS 1,238,978 9/1917 Arthur ..... 30/459

*Primary Examiner*—Frederick R. Schmidt
*Assistant Examiner*—J. T. Zatarga
*Attorney, Agent, or Firm*—Beveridge, DeGrandi & Weilacher

[57] ABSTRACT

Sharpener press-button is disclosed comprising a tubular body having one open end and another end closed by a transverse wall. The transverse wall is formed on its outer surface with an extension cooperative with a propelling pencil for fixing thereto a button. The button has a blade element including a central portion provided with an opening, two lateral converging flanks extending from the central portion and the two ends of the flanks remote from the central portion extending parallel and together in the direction away from the central portion. The blade element is housed within the tubular body, with the ends inserted into a recess in the inner face of the transverse wall and the central portion adjacent the open end of the body, the lateral flanks being formed with cutouts extending in the axial direction of the button and tapered in the direction away from the central portion of the blade element, the button having at least one radial penetrating aperture.

8 Claims, 4 Drawing Figures

SHARPENER PRESS-BUTTON

The present invention relates to a lead sharpener press-button for propelling pencils.

Sharpening press-buttons mounted into and supplied with the propelling pencil itself are already known. The most usual type of these press-buttons comprises a cylindrical tubular body inside which is mounted a blade for sharpening the lead, the blade being fixed to a plug of the tubular body. Said blade can be made in two folded blade parts as well as in a single folded piece insertable into the tubular body, the flanks thereof having the configuration of a fork, to serve as a sharpener for the lead when it is inserted between said two flanks.

Said types of press-buttons for propelling pencils have some disadvantages in common. They do not have a lead-guide, being therefore susceptible to easy breaking of the lead during the sharpening operation. Consequently, the broken piece must be removed before the lead is sharpened again, which is a difficult operation because of the inaccessibility and non visibility of the sharpening blade.

The German Pat. No. 2 130 361 published on Dec. 30, 1971 shows a lead-sharpener press-button consisting of three parts, two of which are made of plastic material, i.e., one part consisting of a cylindrical tubular body which at the end to be fixed to the propelling pencil is provided with a tubular extension insertable into a lead-holding tube, said extension having an outer diameter substantially equal to the internal diameter of the hollow tubular body, the other plastic part being a plug with a blade insertable into said tubular body. In that case, the borehole or the tubular extension serves as a lead-guide during the sharpening operation. However, said press-button has the disadvantage that the dust of lead is retained within the tubular body, hindering the removal thereof because of the small diameter of the borehole, the lead dust being also retained in the transition of the diameters even after strong tapping or jolting of the button. Moreover, because of the insertion of the extension into the lead-holding tube, the lead residues fall through said lead-holding tube, being expelled by the clutch when the press-button is activated to produce the advance movement of the lead, and consequently soiling the paper. Another disadvantage is the fact that this sharpening button can sharpen only a particular long portion of lead because of the long distance between the end of the extension where the lead is inserted and the sharpening blade, so that the terminal portions of the leads which could otherwise still be used, are lost.

The object of the present invention is to provide a lead sharpening press-button comprising a tubular body having one substantially open end and another end closed by a transverse wall, characterized by the fact that the transverse wall is formed on its outer surface with an extension coaxial with the body and cooperative with a propelling pencil for fixing thereto said button, the button further comprising a blade element including a central portion provided with a hole, two lateral converging flanks extending from the central portion and the two ends of the flanks farther from the central portion extending parallel and together in the direction away from the central portion, the blade element being housed within the tubular body, with said ends inserted into a recess in the inner surface of the transverse wall and the central portion adjacent the open end of the body, the lateral flanks being formed with cutouts extending in the axial direction of the button and tapered in the direction opposed to the central portion of the blade element, the button body having at least one penetrating radial aperture.

By arranging the lateral openings in radially opposed pairs, preferably two pairs of holes, the completion of the tip can be seen during the sharpening operation, which can be stopped when the tip has acquired the desired thinness.

Moreover, the resulting lead dust is easilly discharged through said lateral openings by means of a simple puff. In the improbable case that the tip should break off inside the sharpener, it could easily be removed by a thin instrument such as a needle or even a bent paper-clip, passing through one of the lateral openings.

In accordance with the preferred embodiment of the invention the blade element consists of a single piece of folded metal strip having a central portion with a guide opening for the lead and two lateral converging flanks provided with cutouts whose edges serve as blades for sharpening the lead. The lateral flanks converge in the direction opposed to the central portion, the ends of the flanks remote from the central portion extending together, parallely, in the direction away from the central portion. Through said configuration of the blade element it is possible simultaneously to achieve the effects of guiding and sharpening the lead, thereby eliminating the possibility of breaking the lead. The ends of said blade element sequential to said lateral flanks are connected in a juxtaposed way so that they can be easily introduced and fixed in a cavity within the tubular body, making unnecessary any other fixing means or agent.

Since the press-button consists of only two parts, it is easy to make, the blade element being insertable into the tubular body by means of a light pressure and being positioned with its central flank portion adjacent the open end of the body and the juxtaposed ends of the blade element inserted into the recess. A secure fixing of the blade element is provided by stops molded in the upper internal portion of the tubular body and facing inward, engaging the central portion of the blade element.

Moreover, to facilitate insertion of the press-button into the lead-holding tube, the extension is gradually tapered in the direction of its free end. This graduation has the effect of permitting an axial force which prevents sliding in that direction when sharpening. The extension preferably exhibits a rough surface provided by grooves or the like to give a good contact of the thumb and the index finger when rotated between said fingers, in order to improve the grip and prevent sliding between the fingers.

A preferred embodiment of the present invention will now be described in more detail with reference to the accompanying drawings, in which.

Figure 1:
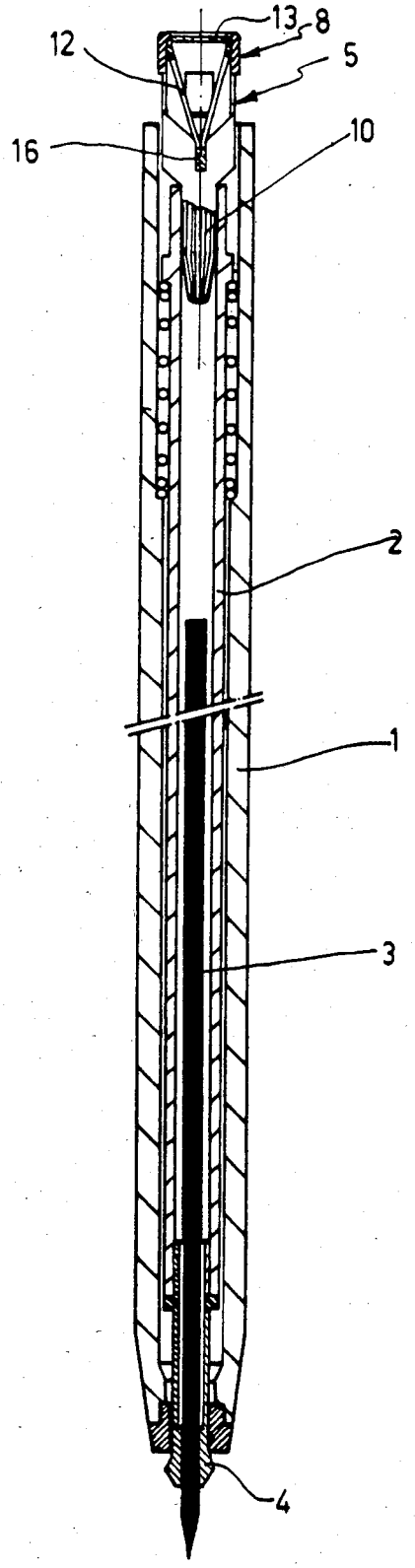
FIG. 1 is a longitudinal section of a propelling pencil provided with a sharpener press-button in accordance with the invention.

With a more detailed reference to the drawings, FIG. 1 shows a total view of a propelling pencil comprising an elongated tubular housing 1 inside of which is mounted a lead-holding tube 2 for receiving the lead 3 itself. The lower end of the lead-holding tube 2 exhibits a pair of grips 4 for fixing the lead 3, which are not explained in detail because they are not within the scope of the invention.

In the upper end of the lead-holding tube 2, opposed to the grips, is mounted a press-button generally referred to by number 5, which will be explained hereinafter.

Figure 2:
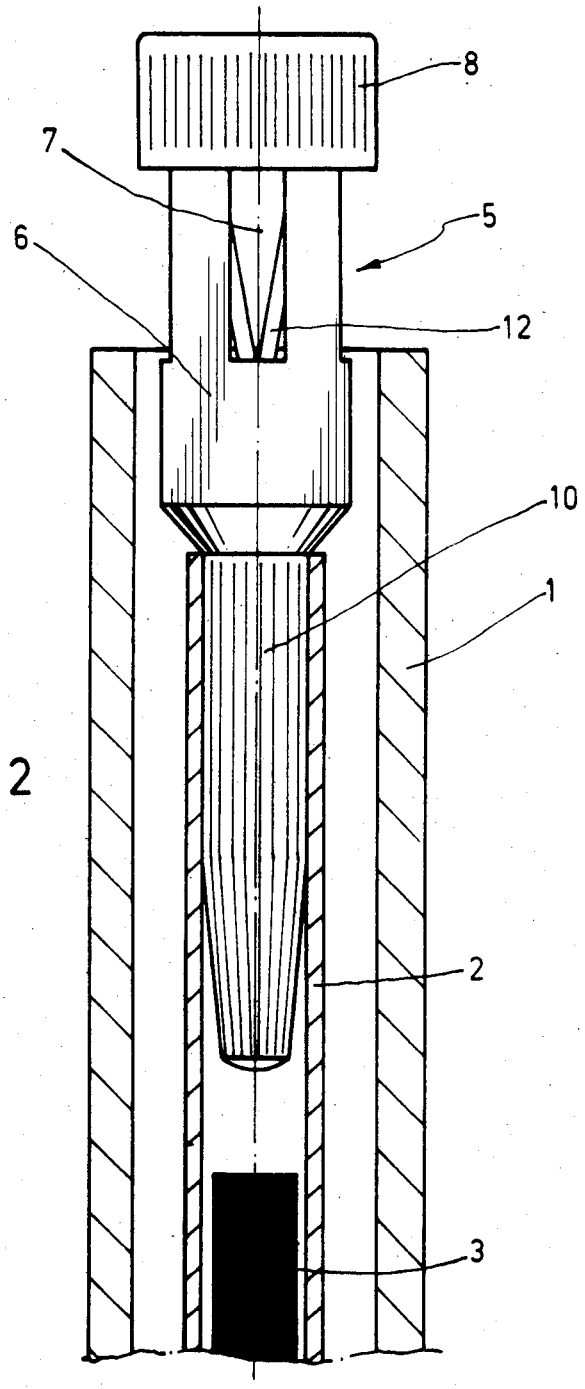
FIG. 2 shows a detail of the press-button mounted in the propelling pencil, the latter being represented in a longitudinal section.
Figure 3:
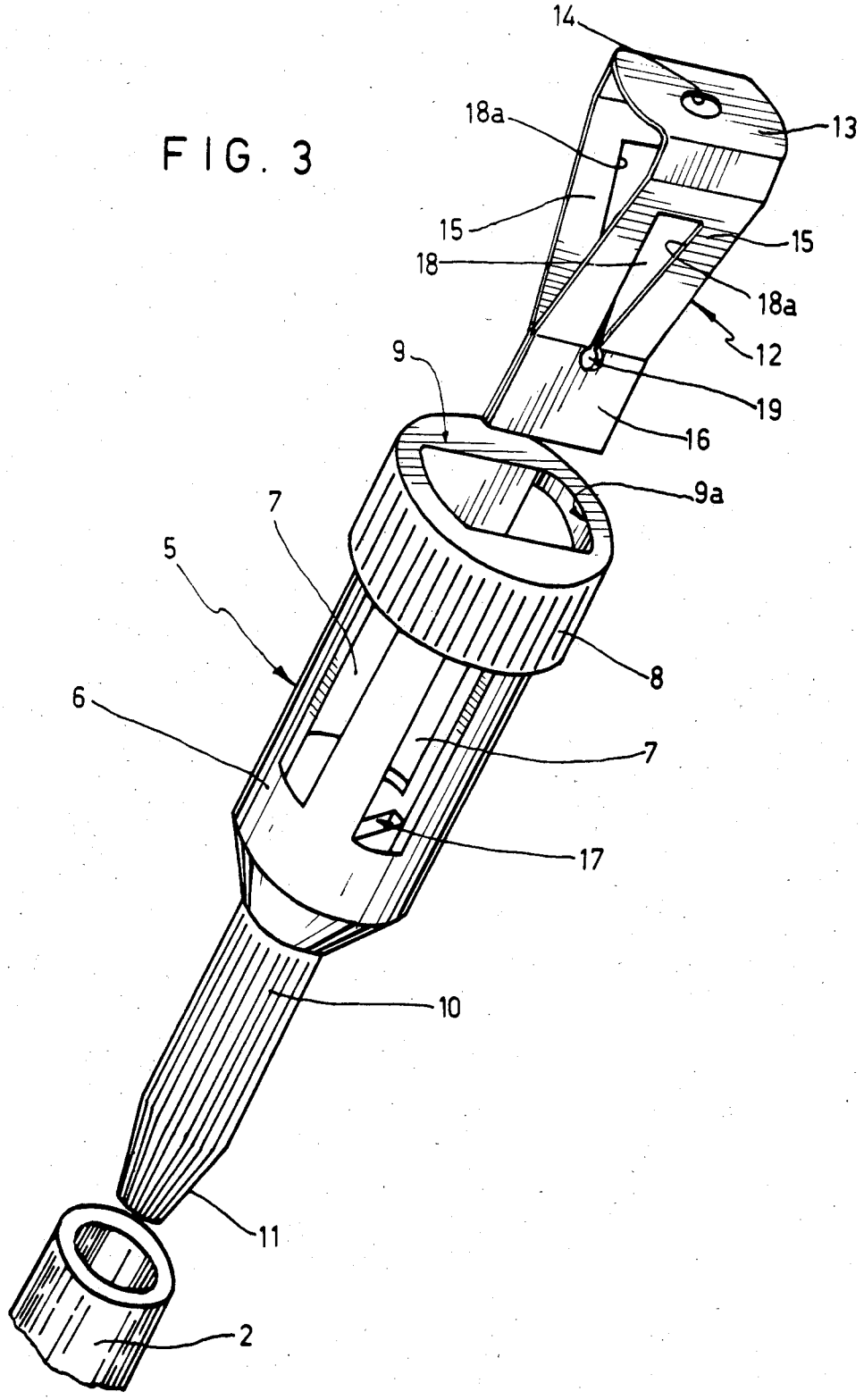
FIG. 3 shows an exploded perspective view of the components of the press-button in accordance with the invention as well as the upper portion of the lead-holding tube of the propelling pencil.
Figure 4:
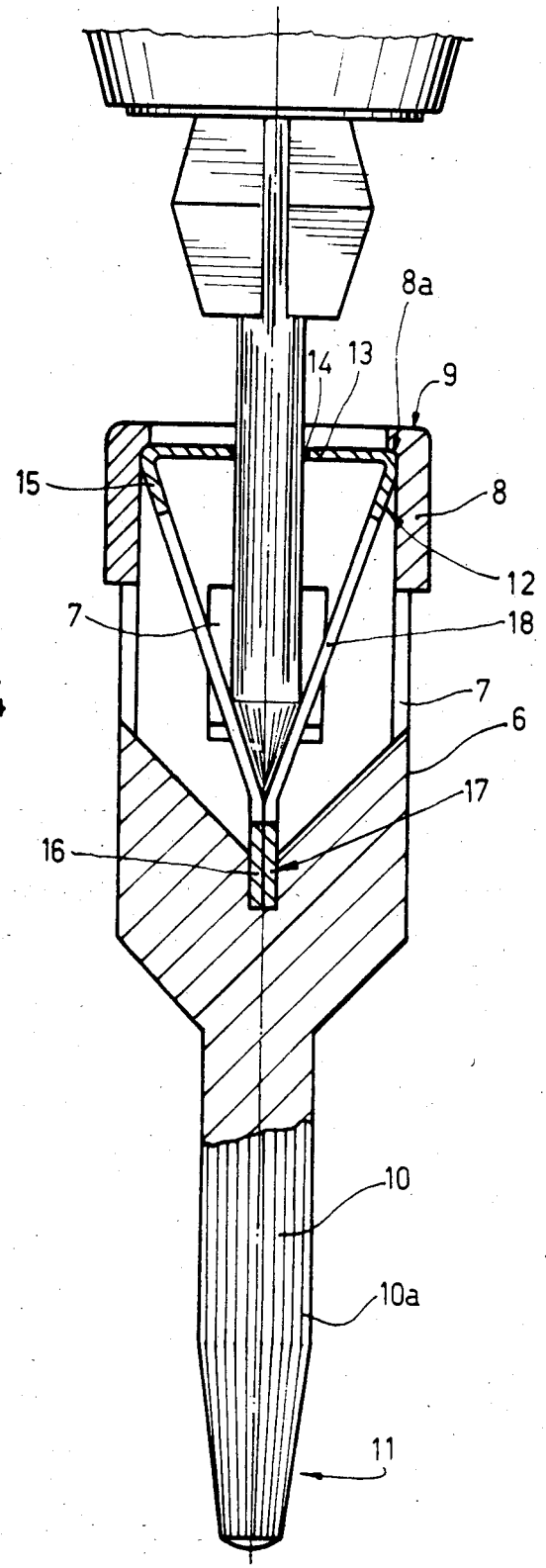
FIG. 4 is a longitudinal section of the press button in the lead sharpening position.

With reference to FIG. 2, the press-button 5 consists of a cylindrical tubular body 6 provided on its lateral surface with four axially extending rectangular radial apertures 7 which are uniformly distributed about the circumference. In its upper end, the tubular body 6 exhibits a circumferential grooved rim 8 to facilitate holding. On its upper face it is provided with a substantially rectangular hole 9*a* for receiving therethrough a blade element which will be described hereinafter. In the end which is fixable to the propelling pencil, the tubular body 6 has a cylindrical extension 10 with a smaller diameter which is configured with grooves 10*a* to allow good pressure and rotation between the forefinger and the thumb of the user when sharpening the lead in the sharpener. In the lower part, the extension 10 exhibits a tapered end 11 to facilitate its insertion into the lead-holding tube 1.

The blade element 12 of the sharpener press-button 5 is made from a single substantially rectangular metal strip folded four times so as to constitute an isosceles triangle when viewed from the side. It exhibits an upper central portion 13 corresponding to the base of the triangle, which is provided with a circular opening 14 of substantially the same diameter as the lead, which constitutes a point of support for the lead, so as to prevent its breaking off during the sharpening operation. Said central flank 13 is followed by two identical lateral flanks 15, forming between them an acute angle and ending in juxtaposed outer portions 16, insertable into a slot 17 within the tubular body 6. To mount or insert said blade element 12 into the tubular body 6 it is sufficient to introduce portions 16 thereof into the tubular body 6 through the hole 9*a*, until the portions 16 enter the slot 17 in the body end wall its retention being ensured by means of stops 8*a* molded on in the upper inner portion of the rim 8. The lateral flanks 15 are provided with cutouts 18 in the shape of isosceles triangles whose vertices converge downwardly, i.e., toward a point on the edge of transition from the lateral flanks 15 to the juxtaposed end portions 16, which are provided with substantially circular cutouts. The edges 18*a* of the notches 18 constitute the sharpening blades themselves, and since the blades are axially aligned with the opening 14, the opening ensures support of the lead, thereby largely preventing its breaking-off. An additional advantage is provided by the fact that, since the blades are arranged on the upper end of the press-button, it is possible to sharpen the end portions of the lead constituted of small lead pieces, thereby avoiding the losses which generally occur in conventional press-buttons.

Due to the fact that it is possible to see the blade element 12 through the radial holes 7, it is possible to sharpen the lead to the desired fineness, avoiding excessive sharpening.

I claim:

1. Sharpener press-button, comprising a tubular body having one substantially open end and another end closed by a transverse wall, characterized by the fact that the transverse wall is formed on its outer surface with an extension (10) coaxial with the body (6) and cooperative with a propelling pencil for fixing thereto said button, the button (5) further comprising a blade element (12) including a central portion (13) provided with an opening (14), two lateral converging flanks (15) extending from the central portion (13) and the two ends (16) of the flanks remote from the central portion extending parallel and together in the direction away from the central portion (13), the blade element (12) being housed within the tubular body (6), with said ends (16) inserted into a recess (17) in the inner face of the transverse wall and the central portion (13) adjacent the open end (9*a*) of the body, the lateral flanks (15) being formed with cutouts (18) extending in the axial direction of the button and tapered in the direction away from the central portion (13) of the blade element (12), the button body having at least one radial penetrating aperture (7).

2. Press-button in accordance with claim 1, characterized by the fact that the radial apertures (7) are uniformly distributed around the body (6).

3. Press-button in accordance with claim 1 or 2, characterized by the fact that the body (6) is formed with four radial apertures (7).

4. Press-button in accordance with claim 1, characterized by the fact that the blade (12) element consists of a single piece of metal folded substantially into a delta-shape, provided in its central portion (13) with an opening (14) for guiding a lead and in its lateral flanks (15) with cutouts (18) whose edges (18*a*) serve for sharpening the lead (3).

5. Press-button in accordance with claim 4, characterized by the fact that the blade (12) element is insertable into the tubular body (6) by means of axial pressure, being retained in the body by internal stops (8*a*) moulded in said body.

6. Press-button in accordance with claim 1, characterized by the fact that the extension (10) is tapered in the direction of its free end.

7. Press-button in accordance with claim 1, characterized by the fact that the extension (10) exhibits a rough surface.

8. Press-button in accordance with claim 7, characterized by the fact that the roughness of the extension (10) is formed by longitudinal grooves (10*a*).

* * * * *